US005435286A

United States Patent [19]

Carroll, III et al.

[11] Patent Number: 5,435,286

[45] Date of Patent: Jul. 25, 1995

[54] BALL LINK ASSEMBLY FOR VEHICLE ENGINE DRIVE TRAINS

[75] Inventors: John T. Carroll, III; David P. Genter, both of Columbus, Ind.

[73] Assignee: Cummins Engine Company, Inc., Columbus, Ind.

[21] Appl. No.: 235,891

[22] Filed: May 2, 1994

[51] Int. Cl.[6] ..... F02M 37/04; F01L 1/14

[52] U.S. Cl. ..... 123/508; 123/90.61; 74/579 R

[58] Field of Search ..... 132/90.61, 90.51, 507, 132/508; 74/579 R

[56] References Cited

U.S. PATENT DOCUMENTS

| | | | |
|---|---|---|---|
| 2,636,757 | 4/1953 | Bakane | 123/90.61 |
| 2,970,585 | 2/1961 | Lombardi | 123/90.61 |
| 2,975,775 | 3/1961 | Macura | 123/90.61 |
| 3,066,658 | 12/1962 | Gondek | 74/579 |
| 3,908,615 | 9/1975 | Hayward | 123/90.61 |
| 4,141,329 | 2/1979 | Pompei | 123/508 |
| 4,436,063 | 3/1984 | Usui | 123/90.61 |
| 4,806,040 | 2/1989 | Gill et al. | 403/24 |
| 4,848,286 | 7/1989 | Bentz | 123/90.61 |
| 4,962,743 | 10/1990 | Perr et al. | 123/508 |
| 4,966,108 | 10/1990 | Bentz et al. | 123/90.51 |
| 5,083,884 | 1/1992 | Miller et al. | 403/404 |
| 5,323,750 | 6/1994 | Rotter | 123/508 |

FOREIGN PATENT DOCUMENTS

| | | | |
|---|---|---|---|
| 8307 | 1/1982 | Japan | 123/90.61 |
| 57-13203 | 1/1982 | Japan . | |

*Primary Examiner*—Henry C. Yuen
*Assistant Examiner*—Weilun Lo
*Attorney, Agent, or Firm*—Sixbey, Friedman, Leedom & Ferguson

[57] ABSTRACT

A ball link assembly in which a link member has a semi-spherical cavity formed in each end for rotatably receiving a respective complementary spherical bearing ball formed, preferably, of a ceramic material. Each ball is freely retained by a ball retainer formed of spring steel, the ball retainer extending just over the equator of the ball and mounting to the link by a sideways snap-on action. In one form, the link is designed to accommodate an existing link retainer which is fixed internally of the injector assembly, while in a second form the link assembly is retained by a link retainer which is externally tethered.

26 Claims, 6 Drawing Sheets

BALL LINK ASSEMBLY FOR VEHICLE ENGINE DRIVE TRAINS

BACKGROUND OF THE INVENTION

1. Field of the Invention

The present invention relates to pivot links, such as that by which the rocker lever of a fuel injector drive train acts on the upper plunger of a fuel injector. In particular, the invention relates to such pivot links in which the pivot surface is formed on an element made of a ceramic material.

2. Description of Related Art

Links of the type to which the present invention is directed are comprised of shaft and ball surface portions and act to transfer compressive loads between contact surfaces at a sliding interface without bending moments. Such links are commonplace in engine subsystem drive trains, e.g., valve and fuel injector drive trains, and to reduce wear at the sliding interface, recent developments have been directed toward making the ball surface portion(s) of a ceramic material. For example, U.S. Pat. Nos. 4,806,040; 4,848,286; 4,966,108; and 5,083,884, as well as Japanese Patent Application 57-13203 disclose pivot rods in which the pivot surface is provided by a ceramic element that is fixed to the end of a shaft by such techniques as interference fitting, diffusion bonding and deforming of a sleeve.

However, the performance and durability of links and link joints are largely dependent on the geometric precision (i.e., size, form and finish) of the mating surfaces. Operating stresses, wear and travel (lash) caused by wear are all directly related to dimensional uncertainties (manufacturing tolerances) of critical feature characteristics, such as radius, radius offset, profile, and surface finish. Furthermore, links and link joints are generally designed at the limits of manufacturing and inspection capabilities making the incremental cost of improving geometric precision great, especially when ceramic materials are used, due to the difficulties encountered in machining and non-destructively evaluating component integrity. Bearing type balls made of ceramic materials, e.g., silicon nitride, are commercially available; but, to date, no arrangement has been developed which offers a low cost means of incorporating a free-rolling ceramic ball into a precision component, such a pivot link of the type to which this invention is directed.

U.S. Pat. No. 4,141,329 shows a fuel injection system in which a cam acts on a ball which is rotatable in a socket in the end of a piston stem cap, but such an arrangement cannot be used to provide a ball at both ends of a link shaft and since the ball is not positively retained in its socket by anything other than the force of a spring used to urge the stem cap toward the cam, should lash develop with wear, the potential exists for the ball to become dislodged from the stem cap with possibly disastrous results. U.S. Pat. No. 2,636,757 discloses a ball and socket joint for an engine valve drive train in which a free ball is disposed between a pair of sockets that are coupled by a housing that encloses the ball. However, this arrangement is impractical since the housing coupling the pair of sockets and enclosing the free ball inhibits the pivotal movement that the free ball is intended to facilitate.

Thus, there is still a need for an improved pivot link arrangement by which a free ball can be retained on one or both ends of a pivot link, especially so as to enable a pivot link to be provided with a ceramic ball surface in a way that will reduce manufacturing costs operating stresses, wear and travel (lash).

SUMMARY OF THE INVENTION

In view of the foregoing, it is an object of the present invention to provide an improved pivot link arrangement by which a free ball can be retained on one or both ends of a pivot link.

It is a further object of the present invention to provide a pivot link with a ceramic ball surface in a way that will reduce manufacturing costs operating stresses, wear and travel (lash).

Still another object of the present invention is to achieve the foregoing objects in a way which will allow the pivot link to be used in existing fuel injector drive trains being attachable by the existing link retainer.

An additional object of the present invention, is to provide an alternative embodiment which is retainable by an improved link retainer arrangement.

These and other objects of the invention are obtainable in accordance with preferred embodiments of the present invention in which a link assembly has a body member with a semi-spherical cavity formed in each end for rotatably receiving a respective complementary spherical bearing ball formed, preferably, of a ceramic material. Each ball is freely retained by a ball retainer formed of spring steel, the ball retainer extending just over the equator of the ball and mounting to the link body by a sideways snap-on action. In one form, the link assembly is designed to accommodate an existing link retainer which is fixed internally of the injector assembly, while in a second form, the link assembly is retained by novel link retainer which is externally tethered.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWINGS

In all of the figures of the Drawings, corresponding elements bear the same reference numerals with prime designations (',", etc.) being used to identify those components which have been modified from one embodiment to another.

DETAILED DESCRIPTION OF THE PREFERRED EMBODIMENTS

Figure 1:
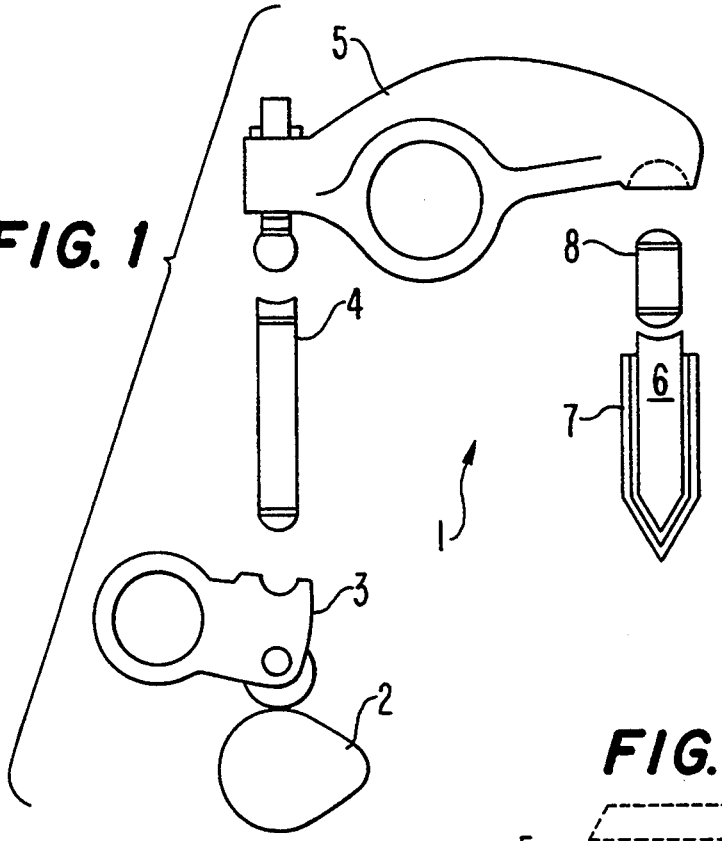
FIG. 1 is a schematic depiction of a fuel injector drive train of the type in which the ball link assembly of the present invention is intended to be used.

From the schematic depiction of FIG. 1, it can be seen that a fuel injector drive train 1 of the type in which the ball link assembly of the present invention is intended to be used comprises a cam 2 which, via a cam follower 3 and pivot rod 4, acts on a rocker lever 5. In turn, movement of the rocker arm 5 produces reciprocation of a plunger assembly 6 of a fuel injector 7 via a pivot link 8.

Figure 2A:
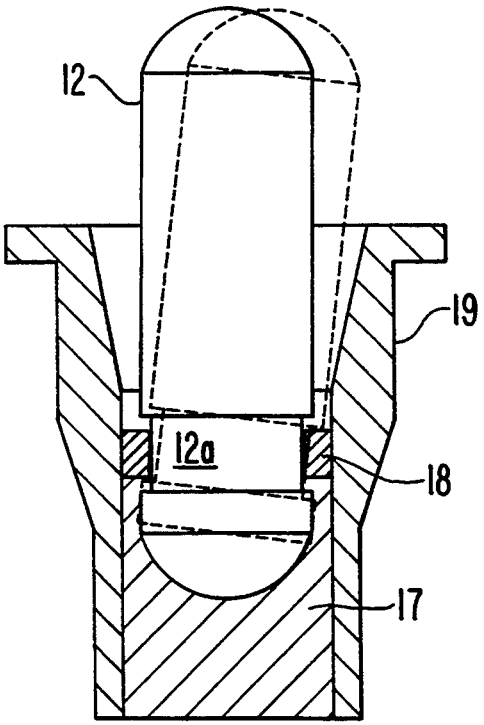
FIG. 2A (PRIOR ART)
FIG. 2A is an enlarged sectional view of the pivot link assembly of the injector of FIG. 2.
Figure 2:
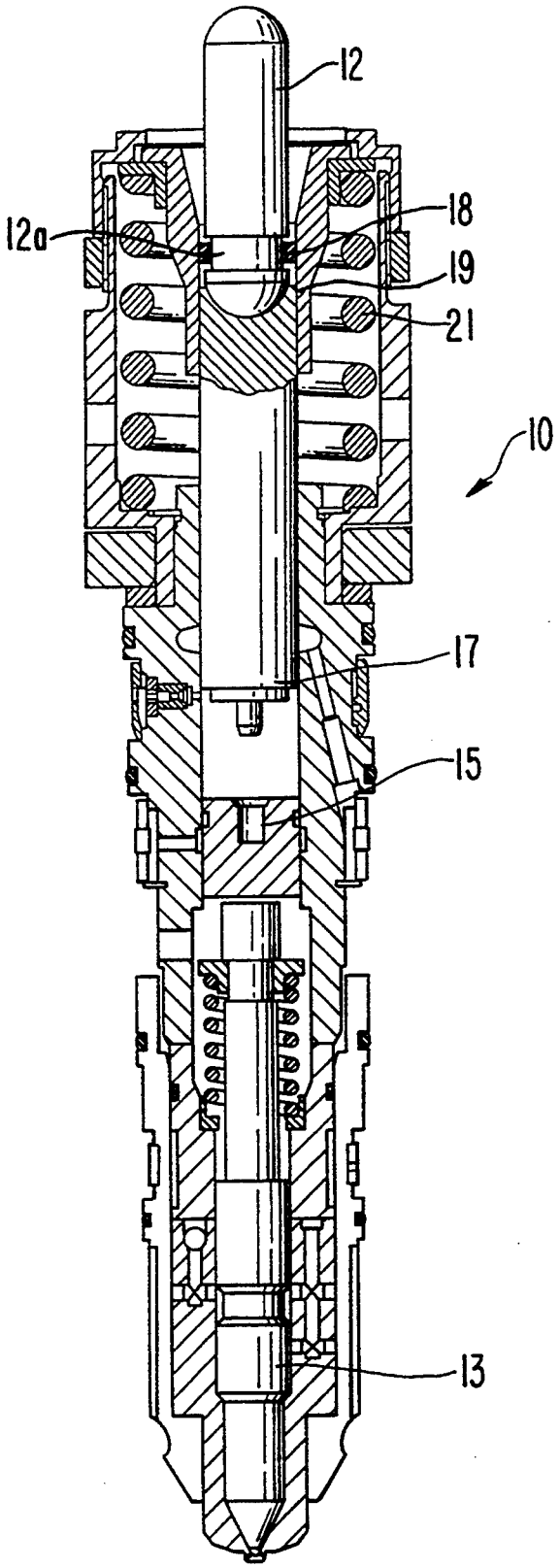
FIG. 2 (PRIOR ART)
FIG. 2 is sectional side view of an existing injector with a known pivot link assembly.

FIG. 2 shows a known fuel injector 10, corresponding to fuel injector 7 of FIG. 1, which has a conventional, one-piece pivot link 12 retained therein which corresponds to pivot link 8 of FIG. 1. In this case, the plunger assembly 6 is comprised of a lower injection plunger 13, an intermediate timing plunger 15 and an upper plunger 17. Retention of pivot link 12 in contact with a complementarily shaped socket at the top end of upper plunger 17 is achieved by radially sliding an internal pivot link retainer 18 onto the pivot link 12 in the area of a retention groove 12*a* which is formed on the pivot link for this purpose. Link retainer 18 has an internal diameter which is small enough to prevent it from moving axially beyond the confines of retention groove 12*a* while being large enough so as not to interfere with the ability of the pivot link 12 to rock on the top end of the upper plunger 17 (as represented in phantom outline in FIG. 2A). Additionally, the link retainer has an outer diameter that is sized to produce a friction fit securement of the link retainer 18 within an upper plunger coupling member 19 that is secured on the upper end of the upper plunger 17. This plunger coupling member 19 serves to enable a return spring 21 to raise the upper plunger and pivot link 12, so that they follow the upward return movement of the end of the rocker lever 5 which acts thereon.

With the above in mind, a first embodiment of a ball link assembly 22 will now be described with reference to FIGS. 3–6, which is intended to be substitutable for the prior art pivot link 12 in an injector 10. Ball link assembly 22 is comprised of a body 23 having spherically shaped sockets 23*a*, 23*b* at opposite ends thereof for receiving pivot balls 24. The pivot balls 24 can be commercially available bearing balls made of AFBMA Grade 48 52100 steel or a ceramic material, such as pressureless sintered silicon nitride, use of ceramic balls 24 being preferred for wear-reduction purposes. To retain the balls 24 in the sockets 23*a*, 23*b*, a pair of ball retainers 26 are provided that are made of spring steel.

Figure 5:
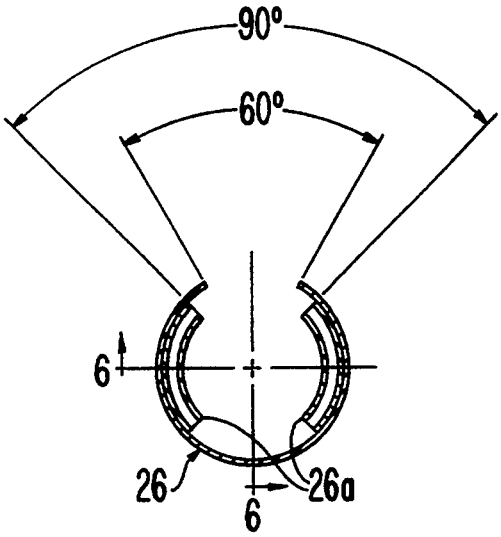
FIGS. 5 & 6 are a plan view and a cross-sectional view of the ball retainer of FIGS. 3 & 4, FIG. 6 being a section taken along line 6—6 in FIG. 5.

The ball retainer 26, as can be seen from FIG. 5, has a C-shape when viewed axially in order that they can be radially snapped onto the body 23 where it is retained by the spring force of the spring steel, which is in a stressed condition when mounted. Additionally, when mounted on the body 23, recessed mounting portions 26*a* of the ball retainer 26 are positively seated within annular recesses 23*c* of the body 23 to which portions 26*a* are cross-sectionally match. These recesses 23*c* correspond to annular recess 12*a* of link 12 and provide an axial symmetry to the ball link assembly 22 which, thereby, allows identical ball retainers to be used at both ends and enables either end of the link assembly to be coupled to the injector. However, since the location of the recesses 23*c* is axially shifted relative to that of recess 12*a*, due to the provision of sockets 22*a*, 22*b*, instead of an integral pivot surface, the link retainer 18' and plunger coupling member 19' have been modified relative to link retainer 18 and plunger coupling member 19. In particular, the interior of plunger coupling member 19 has been modified to provide a larger diameter retaining surface member 19'*a* at an appropriate vertical location and the outer diameter of the link retainer has been correspondingly increased.

Figure 3:
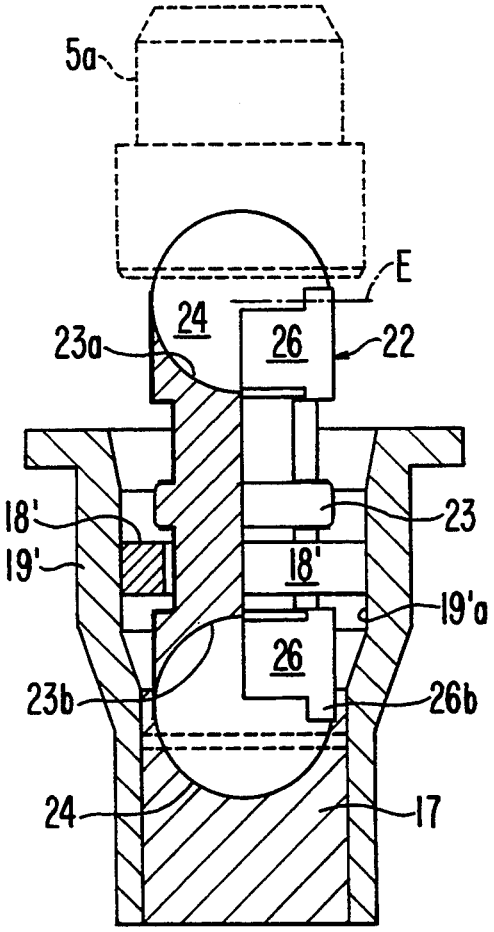
FIG. 3 is a view corresponding to FIG. 2A but with a ball pivot link in accordance with the present invention substituted for the existing unitary pivot link shown in FIGS. 2 & 2A.

As is apparent from FIG. 3, the ball holding portion 26*b* of the ball retainer 26 extends just over the equator E of the pivot ball 24 to an extent that is sufficient to grip the pivot ball at the opposite side of the equator E to prevent the ball from falling out of the socket 23*a*, 23*b* of the link body 23 while not extending so far that ball retainer would interfere with seating of the pivot ball 24 in the lever arm pivot socket (which is represented in phantom in FIG. 3 by a rocker lever pivot insert 5*a*). Not only does the ball retainer 26 effectively retain the pivot ball 24, but it also permits the pivot ball 24 to freely rotate therein. As a result of the pivot ball 24 being able to freely rotate, the effective area over which wear is distributed is greatly increased relative to that of a link having a fixed pivot surface, such as link 12.

As mentioned in connection with the above described embodiment, a modified plunger coupling member 19' is required so that, in instances where the invention is to be retrofit installed, it would be necessary to replace the existing plunger coupling member 19 as a first step, and this cannot be done without disassembling the injector itself due to the manner in which coupling member 19 is normally joined to the upper plunger 17. However, with the external retainers and ball links assembly embodiment described below, a ball pivot link in accordance with the present invention can be retrofit installed in the existing plunger coupling member 19 of an injector 10.

Figure 4:
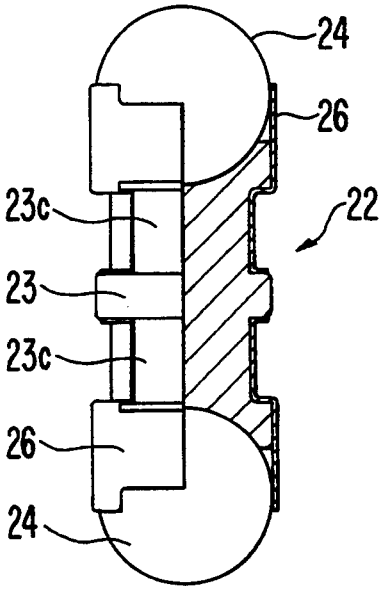
FIG. 4 is a partial cross-sectional view of the ball pivot link shown in FIG. 3.
Figure 6:
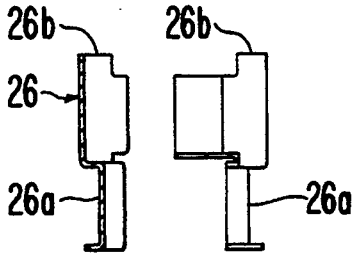
Figure 7:
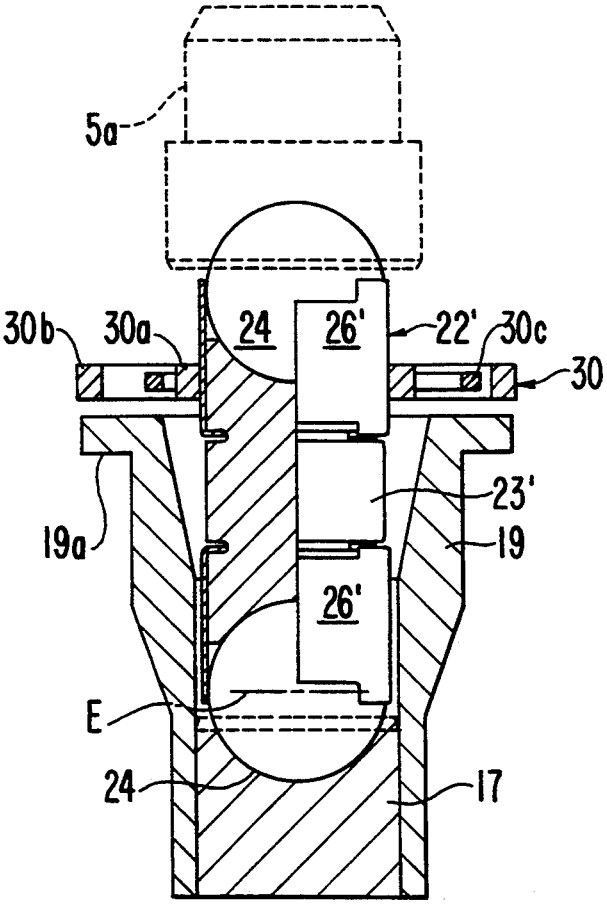
FIG. 7 is a view corresponding to that of FIG. 3 but with a modified ball pivot link and external link retainer, the retainer being sectioned along line 7—7 in FIG. 11.
Figure 8:
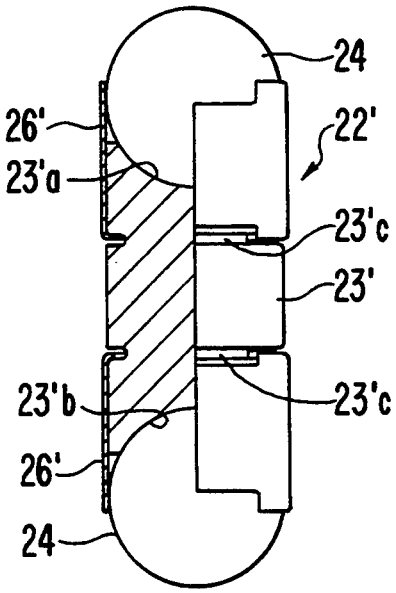
FIG. 8 is a partial cross-sectional view of the ball pivot link shown in FIG. 7.
Figure 9:
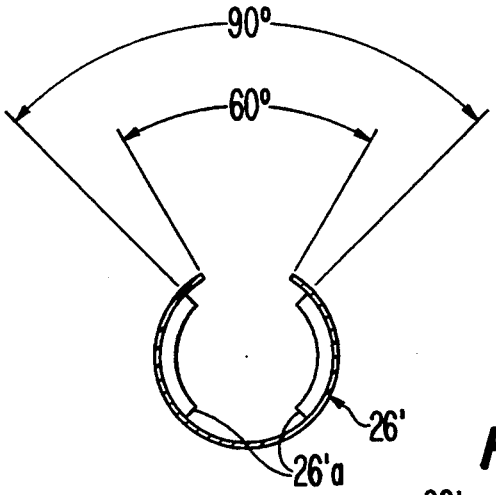
FIGS. 9 & 10 correspond to FIGS. 5 & 6 but show the ball retainer of FIGS. 7 & 8, FIG. 10 being a section taken along line 10—10 of FIG. 9.
Figure 10:
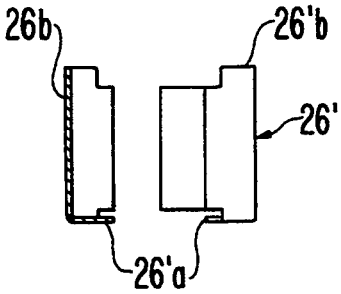

A comparison of the modified ball link assembly 22' of FIGS. 7 & 8 with that of FIGS. 3 & 4 and of the ball retainer 26 of FIGS. 5 & 6 with the ball retainer 26' of FIGS. 9 & 10 reveals that the sole difference between these two ball link assemblies 22, 22' lies in the reduction of annular recesses 23*c* to annular grooves or slots 23'*c* and to eliminate the recess of the mounting portion 26*a*, reducing the mounting portion 26'*a* to a simple flange which engages in the annular grooves 23'*c*. Elimination of the recess of the mounting portion 26*a* allows the length of the ball holding portion 26'*b* that overlies the body 23′ to be increased sufficiently to provide an area upon which an external link retainer 30 can be mounted.

Figure 11:
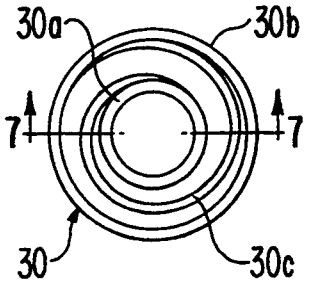
FIG. 11 is a plan view of the external ball pivot link retainer shown in FIG. 7.
Figure 12:
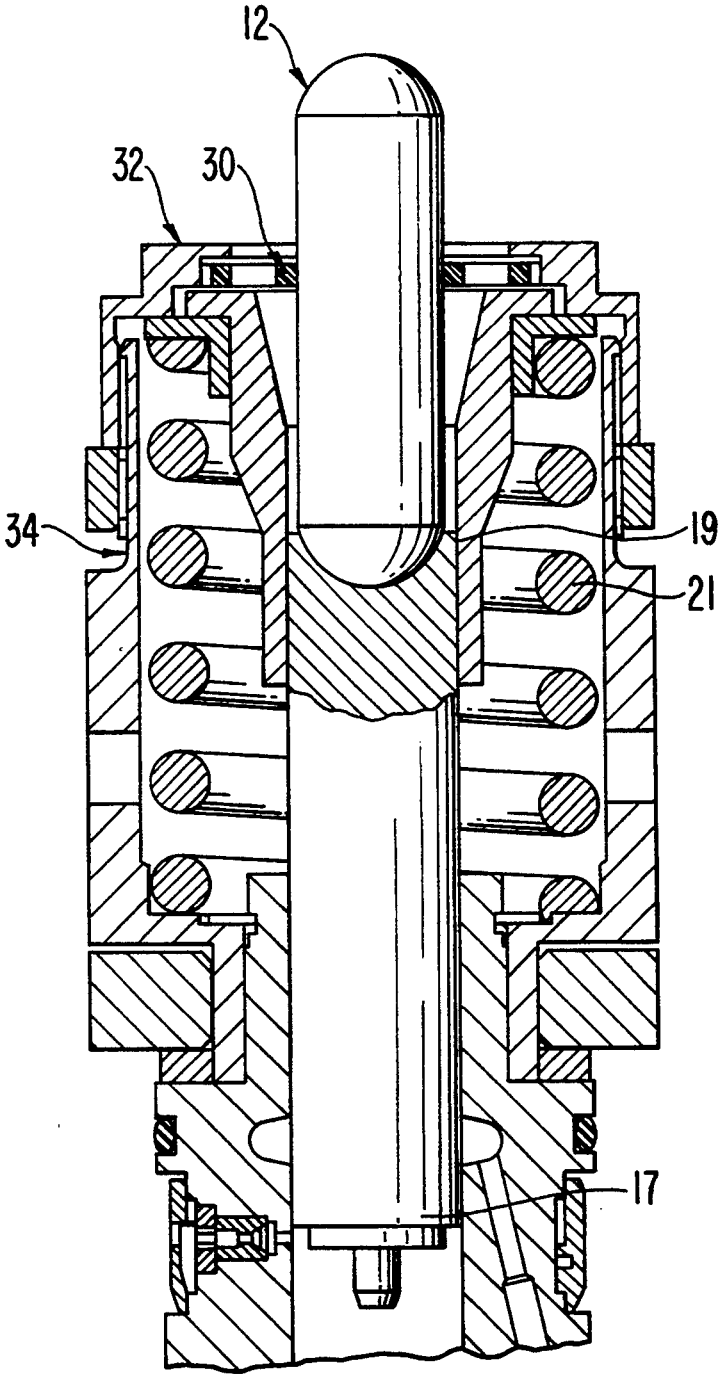
FIG. 12 is cross-sectional view showing the injector of FIG. 2 which has been modified to receive the external ball link retainer of FIG. 11.

As can be seen in FIGS. 7 & 11, the external link retainer 30 is comprised of a pair of annular rings 30*a*, 30*b* which are interconnected by a resiliently flexible strap portion 30*c* which spirals between them. This external link retainer 30 can be formed of a heat resistant plastic with the annular rings 30*a*, 30*b* formed of a single molded piece with the interconnecting strap portion 30*c*. The inner, link-retaining ring 30*a* has an inner diameter sized to friction fit onto the circumference of the upper ball retainer 26′ as shown in FIG. 7. The outer diameter of the outer, mounting ring 30*b* is sufficient to extend onto the spring stop flange 19*a* of the coupling member 19. The mounting ring 30*b* is loosely retained on flange 19*a* by the cap 32 (FIG. 12) of return spring enclosure 34 which can be easily modified to provide sufficient room for the ring 30*b*. Unlike replacement of coupling member 19, the original return spring enclosure cap 32 can be easily replaced without disassembling the injector. As is also apparent from FIG. 12, the external link retainer 30 is usable with an existing link 12 in order to simplify the installation process by eliminating the need to force fit an internal retainer 18 into the coupling member 19.

Figure 13:
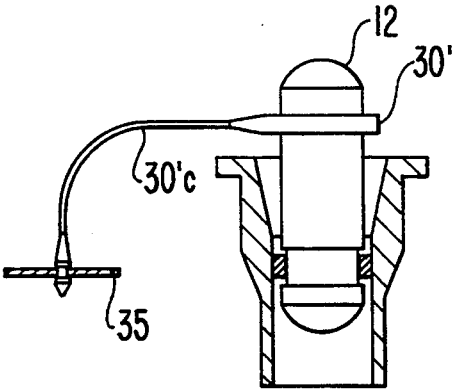
FIGS. 13 & 14 are partial side cross-section views of a second external ball link retainer installed on an existing link assembly and on a ball link assembly in accordance with the present invention, respectively.
Figure 14:
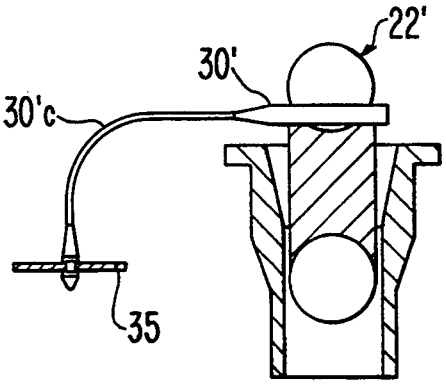
Figure 15:
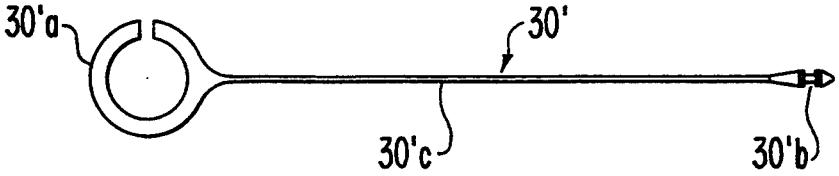
FIG. 15 is a plan view of the second external ball pivot link retainer shown in FIGS. 13 & 14.

FIG. 15 shows another embodiment of an external link retainer 30′ which can be used with either an existing pivot link 12 (FIG. 13) or a pivot link 22′ in accordance with the present invention (FIG. 14). In this case, the link-retaining ring 30′ is a resiliently flexible split ring 30′*a* which is tethered via its strap portion 30′*c* which is formed snap-in mounting portion 30′*b* which has a tapered head with an annular groove. As is represented in FIGS. 13 & 14, mounting portion 30′*b* is secured in an aperture that is provided in a plate 35 which is mounted to the engine, the plate 35 being either specially attached, e.g., to the cylinder head for this purpose or being a portion of a component or bracket already mounted thereon. This external link retainer 30′ eliminates the need to make any modifications to the fuel injector 10.

Figure 16:
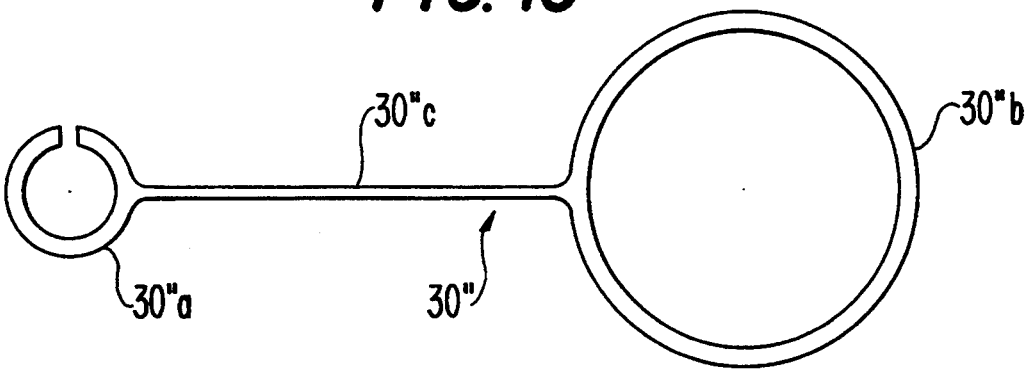
FIG. 16 is a plan view of a third external ball pivot link retainer.
Figure 17:
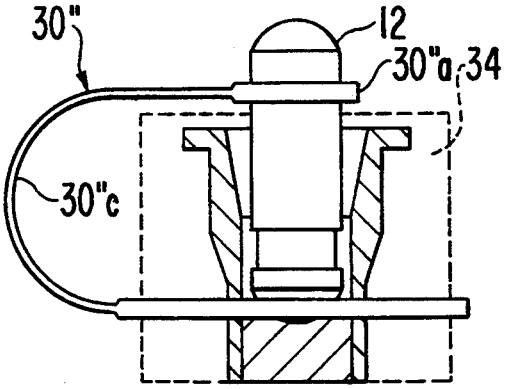
FIGS. 17 & 18 are partial side cross-section views of the retainer of FIG. 16 installed on an existing link assembly and on a ball link assembly in accordance with the present invention, respectively.
Figure 18:
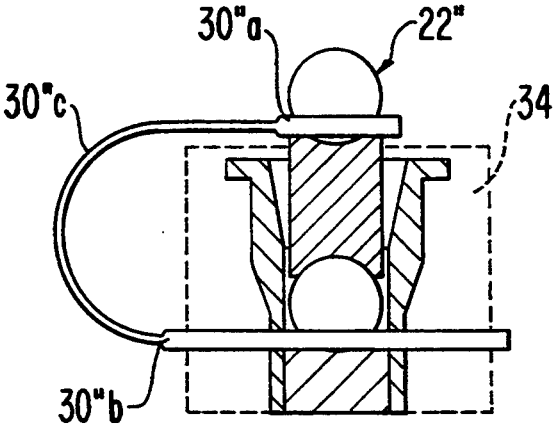

Yet another embodiment of an external link retainer 30″ which can be used with either an existing pivot link 12 (FIG. 17) or a pivot link 22′ in accordance with the present invention (FIG. 18) is shown in FIG. 16. In this version, the mounting portion 30″*b* is in the form of a mounting ring that can be friction-fit over the body of the return spring enclosure 34 as represented diagrammatically in FIGS. 17 & 18. Like the external link retainers 30 and 30′, the external link retainer 30″ is preferably made of a one-piece molded plastic construction. Furthermore, not only does it eliminate the need to make any modifications to the fuel injector 10, but it also eliminates the need for an apertured mounting plate 35.

The above-described invention will afford numerous advantages over existing pivot link assemblies. Firstly, the ball pivot link achieves greater geometric precision with reduced operating stresses, improved ball-socket fit and extended cost savings due, e.g., to reduced wear. For example, the precision previously required for the socket in the upper end of injector plunger 17 and in the rocker lever 5 (socket insert 5*a*) can be reduced without increasing operating stresses so that sufficient control of the mating socket geometry can be achieved by cold forming instead of more expensive machining and grinding approaches. In this regard, it is also noted that spherical sockets can be used in place of off-set socket designs without an operating stress penalty. Moreover, instead of having to machine a ball surface on the link end or on an element to be attached thereto, commercially available bearing type balls can be used on the pivot link with improved wear characteristics. In fact, estimates indicate that a pivot link 22, 22′ in accordance with the present invention can be produced at a cost that is forty-five percent (45%) less than that for a conventional one-piece link 12.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

Industrial Applicability

The present invention will find applicability to a wide range of uses where loadbearing pivot links are required, especially in pivot links for motor vehicle engine drive trains, such as for a pivot link used in a fuel injection system for transmitting motion from a rocker lever to a reciprocating plunger of a fuel injector.

We claim:

1. Link assembly for transferring motion between a pivoting component of an engine drive train and a reciprocating component comprising an elongated link body having a socket formed in each of opposite ends thereof, a bearing-type ball received in each said socket, at least a hemisphere of the ball projecting axial therefrom, and a resilient ball retainer mounted on said link body about each socket, each said resilient ball retainer projecting axially beyond the socket at a respective one of the ends of said link body into resilient engagement with said projecting hemisphere of the ball in the socket to prevent axial dislodgement of the ball from the socket.

2. Link assembly according to claim 1, wherein the bearing-type ball is formed of a ceramic material.

3. Link assembly according to claim 1, wherein the resilient ball retainer has a generally C-shaped ball retaining portion and a pair of mounting portions for engaging in a recessed area of the link body.

4. Link assembly according to claim 3, wherein the recessed area of the link body is an annular recess and the mounting portions of the ball retainer have a cross-sectional shape that is matched to the cross-sectional shape of the annular recess.

5. Link assembly according to claim 4, wherein a ring-shaped link retainer is disposed over said link body at said recess, said link retainer having an inner diameter that is greater than an outer diameter of the link body within said recess so as to provide a clearance therebetween for enabling rocking of the link body relative to said link retainer, and wherein said inner diameter of said link retainer is less than an outer diameter of the link body at axially opposite sides of said recess for preventing the link retainer from passing axially beyond said recess; and wherein said link retainer has an outer diameter that is greater than the outer diameter of the link body at axially opposite sides of said recess for enabling fixing of the retainer within a coupling member of a fuel injector.

6. Link assembly according to claim 3, wherein the recessed area of the link body is an annular groove and the mounting portions of the ball retainer are radially inwardly directed flanges which are engaged in the annular groove.

7. Link assembly according to claim 6, wherein a link retainer is mounted on an upper one of the ball retainers, said link retainer having means for tethering the link assembly to an engine component.

8. Link assembly according to claim 7, wherein said link retainer comprises a pair of rings interconnected by a strap portion, a first of said pair of rings being friction-fit mounted on said upper one of the ball retainers, and wherein said means for tethering is comprised of said strap portion and a second of said pair of rings.

9. Link assembly according to claim 8, wherein said pair of rings are coaxially disposed relative to each other and said strap portion spirals therebetween.

10. Link assembly according to claim 9, wherein said link retainer is formed of a one-piece molded plastic construction.

11. Link assembly according to claim 8, wherein the second of said pair of rings of the link retainer is disposed externally of said first of said pair of rings at an opposite end of said strap portion, said second of said pair of rings having a larger diameter than the first of said pair of rings and is of a sized sufficient for mounting on the periphery of a fuel injector.

12. Link assembly according to claim 11, wherein said link retainer is formed of a one-piece molded plastic construction.

13. Link assembly according to claim 7, wherein the link retainer comprises a ring friction-fit mounted on said upper one of the ball retainers; wherein the strap portion is connected at a first end to the periphery of said ring; and wherein said means for tethering is comprised of said strap portion and an anchoring means for securing a second end of the strap portion in a plate aperture.

14. A fuel injector for an internal combustion engine of the type having a plunger assembly having an upper plunger mounted for reciprocation in a top end of an injector body, said upper plunger having a pivot socket formed therein and a pivot link for transferring movement of an engine drive train to the upper plunger, said pivot link having a spheric surface in engagement with the pivot socket of the upper plunger, and means for retaining the pivot link, wherein the pivot link is formed of a pivot link assembly comprising an elongated link body having a ball socket formed in each of opposite ends thereof, a bearing-type ball received in each said ball socket, at least a hemisphere of the ball projecting axially therefrom, and a resilient ball retainer mounted on said link body about each socket, each said resilient ball retainer projecting axially beyond the socket at a respective one of the ends of said link body into resilient engagement with said projecting hemisphere of the ball in the ball socket to prevent axial dislodgement of the ball from the socket, one of said balls being disposed in the pivot socket of the upper plunger and the other of said balls projecting axially from said fuel injector for transferring motion from a pivoting component of an engine drive train to the reciprocating upper plunger of the fuel injector.

15. Fuel injector according to claim 14, wherein the bearing-type ball is formed of a ceramic material.

16. Fuel injector according to claim 14, wherein the resilient ball retainer has a generally C-shaped ball retaining portion and a pair of mounting portions for engaging in a recessed area of the link body.

17. Fuel injector according to claim 16, wherein the recessed area of the link body is an annular recess and the mounting portions of the ball retainer have a cross-sectional shape that is matched to the cross-sectional shape of the annular recess.

18. Fuel injector according to claim 17, wherein a ring-shaped link retainer is disposed over said link body at said recess, said link retainer having an inner diameter that is greater than an outer diameter of the link body within said recess so as to provide a clearance therebetween for enabling rocking of the link body relative to said link retainer, and an outer surface of said link retainer being coupled to said upper plunger in a manner precluding axial movement therebetween.

19. Fuel injector according to claim 16, wherein the recessed area of the link body is an annular groove and the mounting portions of the ball retainer are radially inwardly directed flanges which are engaged in the annular groove.

20. Fuel injector according to claim 19, wherein a link retainer is mounted on an upper one of the ball retainers, said link retainer having means for tethering the link assembly to an engine component.

21. Fuel injector according to claim 20, wherein said link retainer comprises a pair of rings interconnected by a strap portion, a first of said pair of rings being friction-fit mounted on said upper one of the ball retainers, and wherein said means for tethering is comprised of said strap portion and a second of said pair of rings.

22. Fuel injector according to claim 21, wherein said pair of rings are coaxially disposed relative to each other and said strap portion spirals therebetween; and wherein the second of said pair of rings is coupled to said upper plunger.

23. Fuel injector according to claim 22, wherein said link retainer is formed of a one-piece molded plastic construction.

24. Fuel injector according to claim 21, wherein the second of said pair of rings of the link retainer is disposed externally of said first of said pair of rings at an opposite end of said strap portion, said second of said pair of rings having a larger diameter than the first of said pair of rings and is of a sized sufficient for mounting on the periphery of the fuel injector.

25. Fuel injector according to claim 24, wherein said link retainer is formed of a one-piece molded plastic construction.

26. Fuel injector according to claim 20, wherein the link retainer comprises a ring friction-fit mounted on said upper one of the ball retainers; wherein the strap portion is connected at a first end to the periphery of said ring; and wherein said means for tethering is comprised of said strap portion and an anchoring means for securing a second end of the strap portion in a plate aperture.

* * * * *